United States Patent [19]

Bauch et al.

[11] Patent Number: 4,597,142

[45] Date of Patent: Jul. 1, 1986

[54] APPARATUS FOR CRIMPING SYNTHETIC PLASTIC CABLES

[75] Inventors: Ernst Bauch; Ernst Vehling, both of Bordesholm, Fed. Rep. of Germany

[73] Assignee: Neumuenstersche Maschinen- und Apparatebau GmbH, Neumuenster, Fed. Rep. of Germany

[21] Appl. No.: 647,132

[22] Filed: Sep. 4, 1984

[30] Foreign Application Priority Data

Sep. 8, 1983 [DE] Fed. Rep. of Germany ..... 3332387

[51] Int. Cl.[4] ..... D02G 1/12

[52] U.S. Cl. ..... 28/269

[58] Field of Search ..... 28/263, 264, 268, 269; 226/90, 187

[56] References Cited

U.S. PATENT DOCUMENTS

| | | | |
|---|---|---|---|
| 3,220,083 | 11/1965 | Crawford et al. | 28/269 |
| 3,639,955 | 2/1972 | Fleissner et al. | 28/269 |
| 4,033,496 | 7/1977 | Rolfe | 226/187 X |

FOREIGN PATENT DOCUMENTS

| | | | |
|---|---|---|---|
| 506071 | 9/1954 | Canada | 28/269 |
| 110471 | 4/1964 | Czechoslovakia | 28/263 |
| 1035607 | 8/1958 | Fed. Rep. of Germany | 226/187 |
| 1435365 | 4/1969 | Fed. Rep. of Germany | . |
| 1908632 | 9/1969 | Fed. Rep. of Germany | 28/269 |
| 1816028 | 6/1982 | Fed. Rep. of Germany | . |

*Primary Examiner*—Robert R. Mackey

*Attorney, Agent, or Firm*—Michael J. Striker

[57] ABSTRACT

An apparatus for crimping cables formed of synthetic filaments during a continuous spinning-stretching process includes two pressing rolls which form a crimping chamber into which a cable to be crimped by the rolls is inserted. One of the rolls is displaced from an operative position to a readiness position at a full apparatus speed. Upon displacement of the pressing roll into the ready-to-operate position, a gap between the rolls becomes wider and the crimping chamber opens longitudinally so that a passage is formed, which allows the cable to be inserted into the chamber from the front side thereof by means of a suction injector.

4 Claims, 10 Drawing Figures

FIG. 5
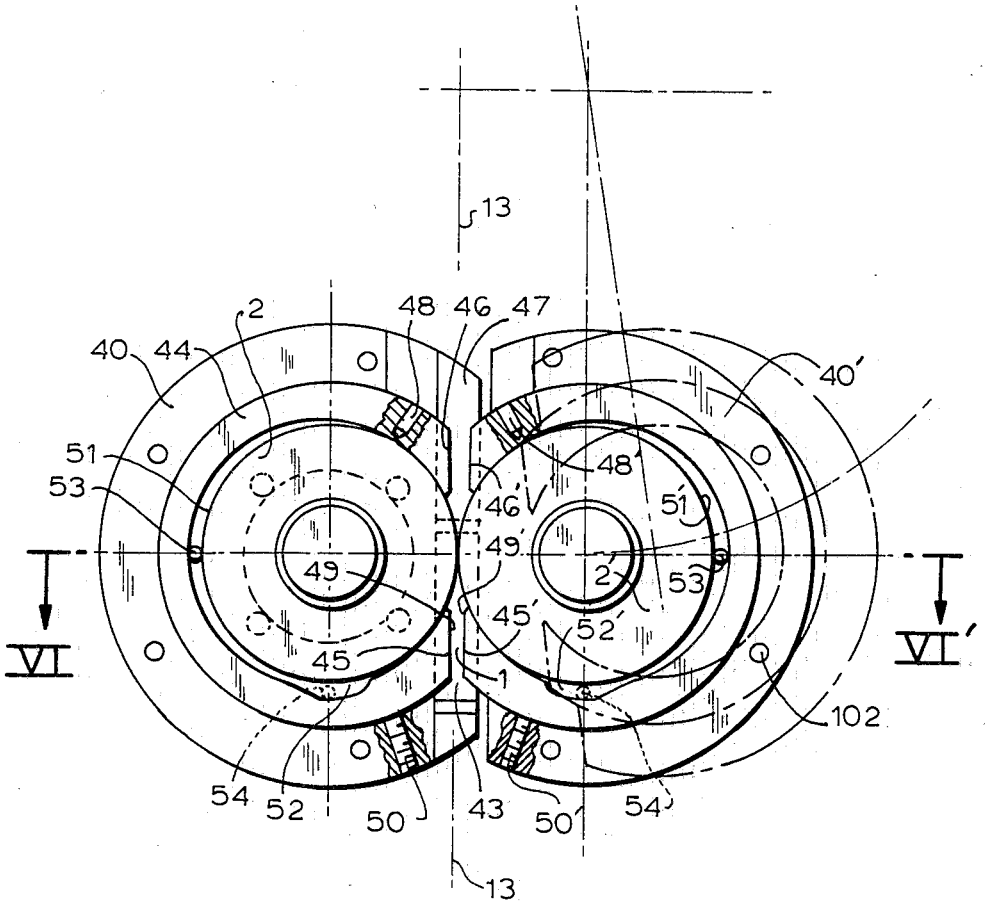
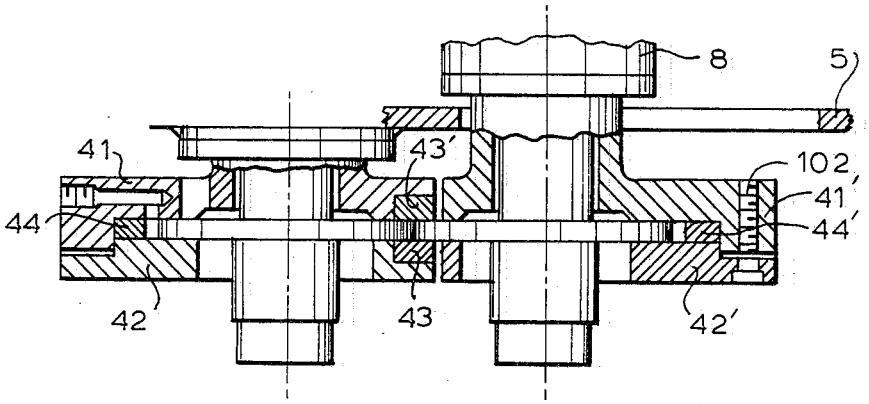
FIG. 6

FIG. 5a
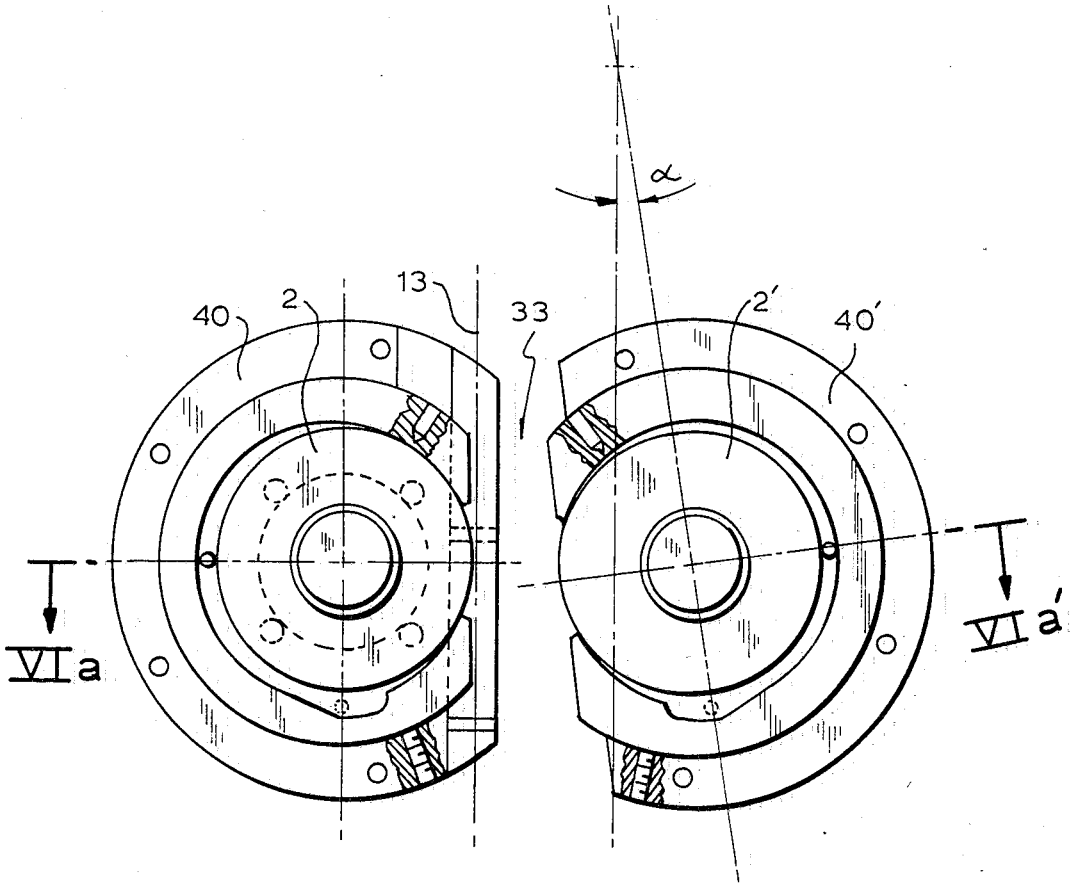
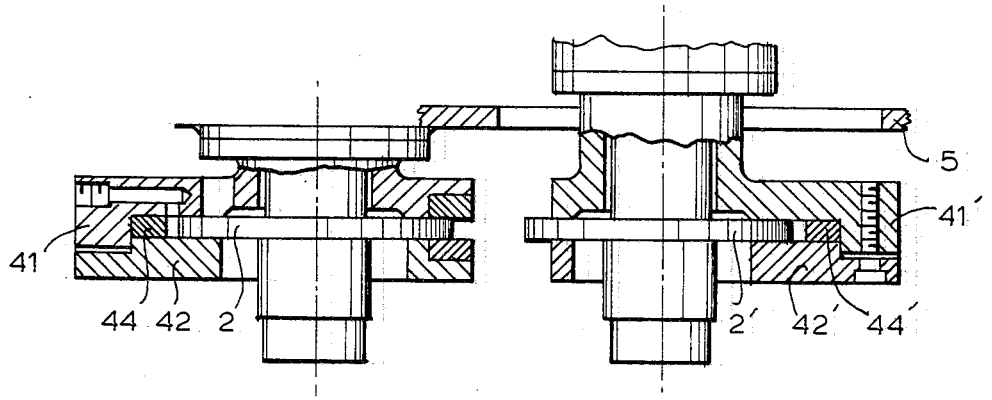
FIG. 6a

APPARATUS FOR CRIMPING SYNTHETIC PLASTIC CABLES

BACKGROUND OF THE INVENTION

The present invention relates to an apparatus for crimping cables, particularly cables made of synthetic plastic filaments. Even more particularly, this invention relates to a crimping apparatus provided with a compression chamber.

Crimping of cables formed of synthetic plastic filaments in mechanical compression chambers takes place in practice at the present time at operation speeds up to 300 m/min. A number of filament bundles are pulled out from a container and are combined into a cable which is fed with an overall size of up to 4,000,000 dtex into the compression chamber. The operation of the apparatus is carried out in such a fashion that the starting end of the cable is inserted into the gap between the pressing rolls when the apparatus is non-operative, and then the speed of the movable components of the apparatus is increased.

Such methods of crimping cables have been already described. In conventional methods, however due to the intermediate storage of the cable in the containers there have been losses. With these methods, the newly spun synthetic filaments are stretched in a continuous process, then crimped and eventually cut off to a size suitable for staple. It must be natural to assume that the insertion of the cable into the compression chamber should be carried out at a full operational speed. With customary dry spinning methods, the spinning speed is 500 m/min or higher so that, with a stretching ratio from 1 to 4 for the stretched cable, the speed of at least 2,000 m/min results. However, it has been very difficult or practically impossible with conventional mechanical compression chambers to insert the cable into such a chamber with the above speed.

German Pat. No. 1,816,028 discloses a crimping apparatus with a compression chamber in which one of the pressing rolls together with the pivotally positioned intermediate element, which closes the chamber in the operative position, is supported on rocking arm so that the pressing roll is pivoted out from the operation position. Thereby the cleaning and maintenance of the compression chamber are facilitated. The publication, however does not suggest that a cable could be inserted into the open compression chamber while the motors of the device are switched on. Obviously the insertion of the cable during the operation of the motors into the open compression chamber is not possible in the disclosed device because lateral access to the chamber is blocked by the machine components.

German Offenlegungsschrift No. 1,435,365 discloses an apparatus in which the compression chamber is formed by two suspended compression rolls and in which a gap between the rolls can be freed at one side by returning flaps provided on the side plate. However, there is no suggestion that the compression rolls could be moved away from the operative position to provide an enlarged gap between the rolls.

A crimping device for crimping synthetic plastic filaments has been also disclosed, for example, in applicant's U.S. Pat. No. 3,887,972.

SUMMARY OF THE INVENTION

It is an object of the present invention to provide an improved apparatus for crimping synthetic cables.

It is another object of this invention to provide an apparatus in which the cable can be inserted between the pressing rolls at full speed during a continuous spinning-stretching operation.

These and other objects of the invention are attained by a crimping apparatus for crimping synthetic plastic cables, comprising two rotary pressing rolls positioned relative to each other with a gap therebetween and forming a compression chamber at said gap, said rolls cooperating with each other to crimp a cable inserted into the compression chamber; two side plates and two intermediate elements enclosing said compression chamber at four sides thereof; means for displacing one of said pressing rolls and one of said intermediate elements enclosing said compression chamber from an operative position to a readiness position so as to enlarge said gap and open said compression chamber longitudinally and to provide between said rolls in said readiness position a passage for the insertion of the cable into the open compression chamber without requiring to stop the apparatus; and a housing having two housing portions each enclosing a respective pressing roll, said one pressing roll being connected to the assigned housing portion for displacement therewith in a concentrical recess in a respective one of said housing portions and means for securing each said ring in an adjusted position within the respective housing portion.

The displacing means may include a rocking member, said one roll having an axis, said one roll and said one intermediate element being supported on said rocking member which is pivotable about an axis which is parallel to the axis of said one roll.

Each of the rolls may have an individual drive motor, the drive motor of said one roll being supported on said rocking member, which makes possible the displacement of the pressing roll into the ready-to-operate position during the running of the apparatus.

The pressing rolls may be supported in the apparatus in an overhung position, whereby the front side of the apparatus becomes accessible in the ready-to-operate position for the insertion of the cable into the compression chamber.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 5 is a front view of the compression rollers of the device of another embodiment of the invention;

FIG. 5*a* is a detail of FIG. 5 of the device in a ready-to-operate position;

FIG. 6 is a section taken along line VI—VI' of FIG. 5; and

FIG. 6*a* is a section taken along line VIa—VIa' of FIG. 5*a*.

DETAILED DESCRIPTION OF THE PREFERRED EMBODIMENTS

Figure 1:
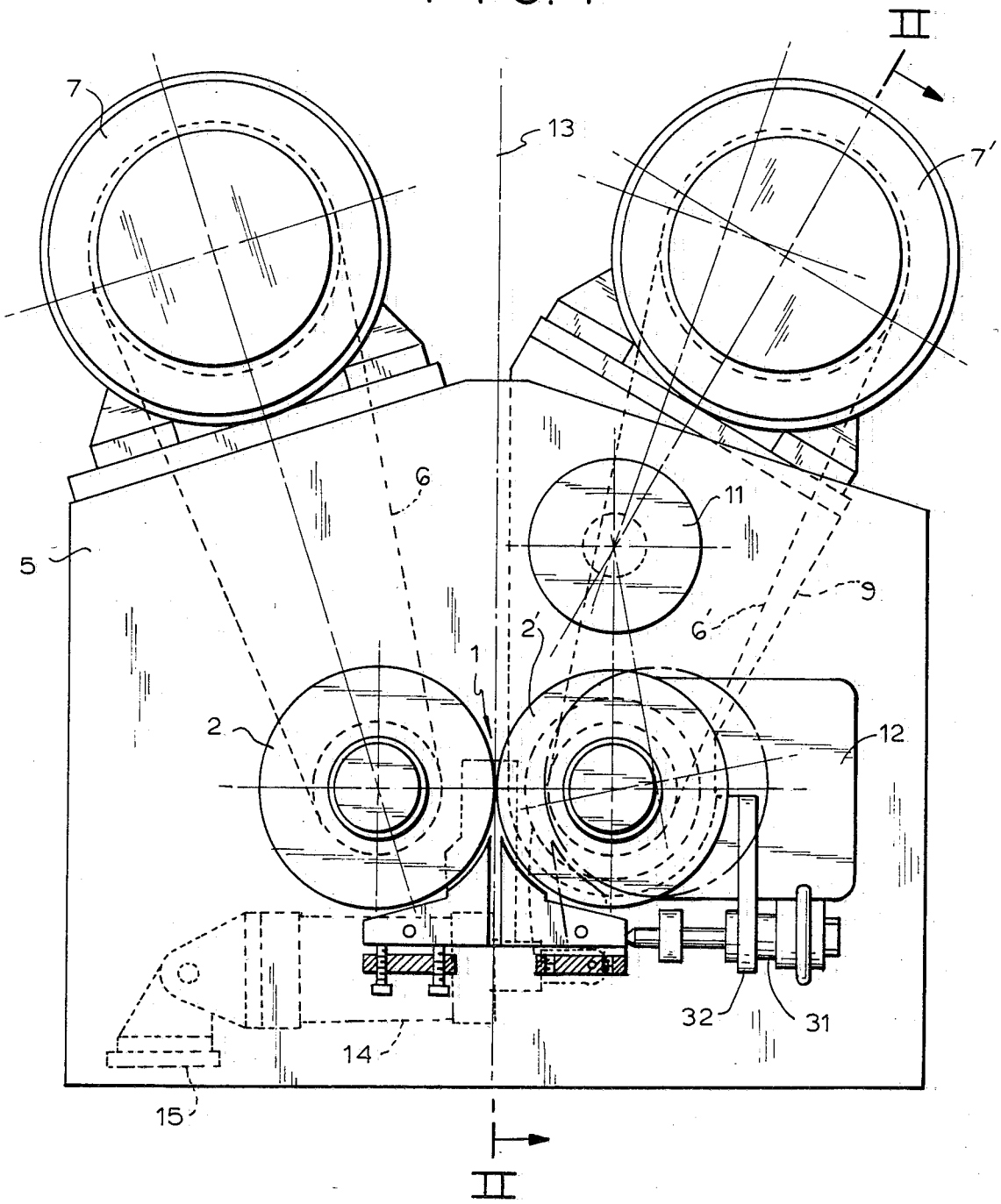
FIG. 1 is a schematic front view of a crimping device with a compression chamber in an operative position.
Figure 2:
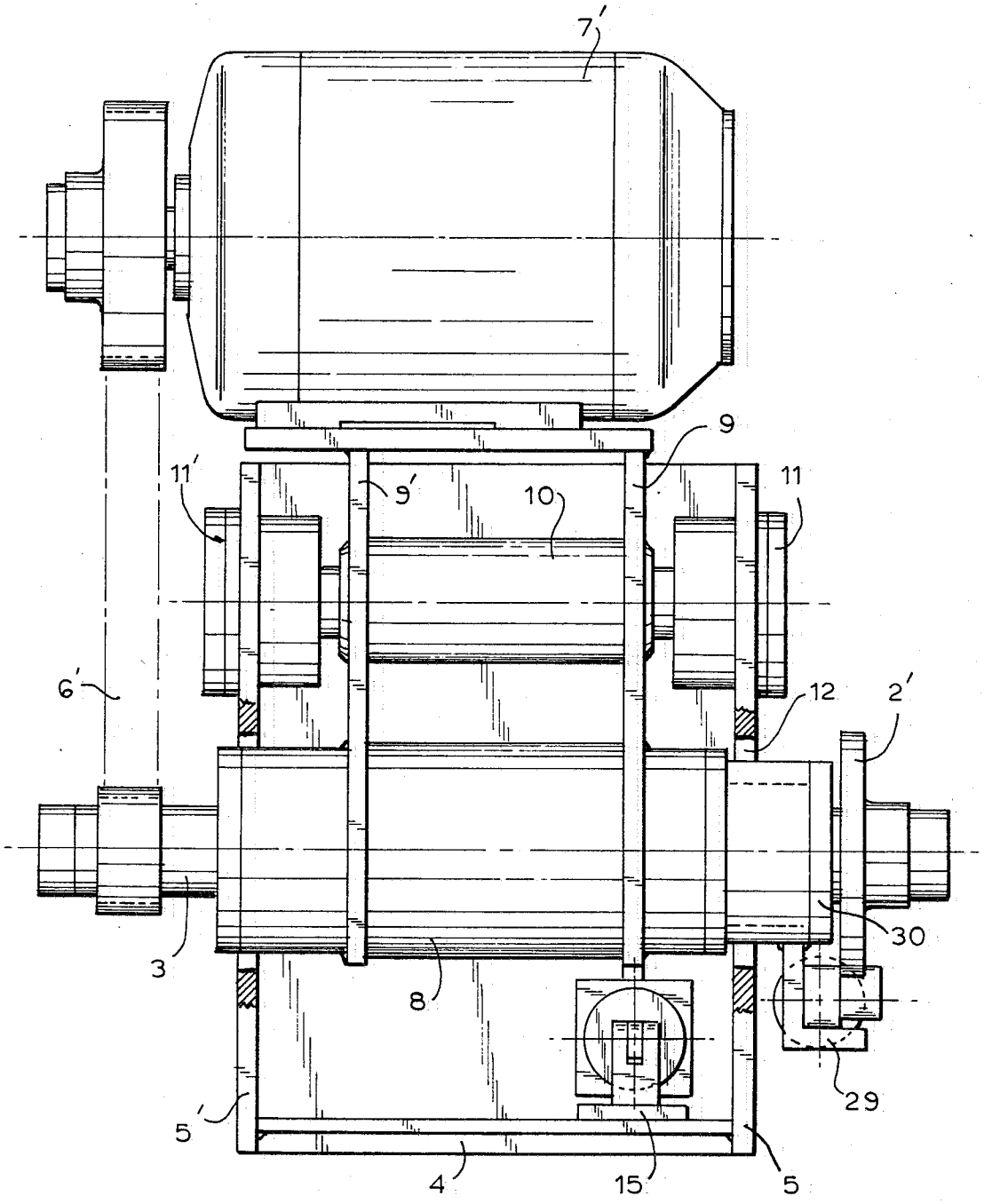
FIG. 2 is a sectional view along line II—II' of FIG. 1.
Figure 4:
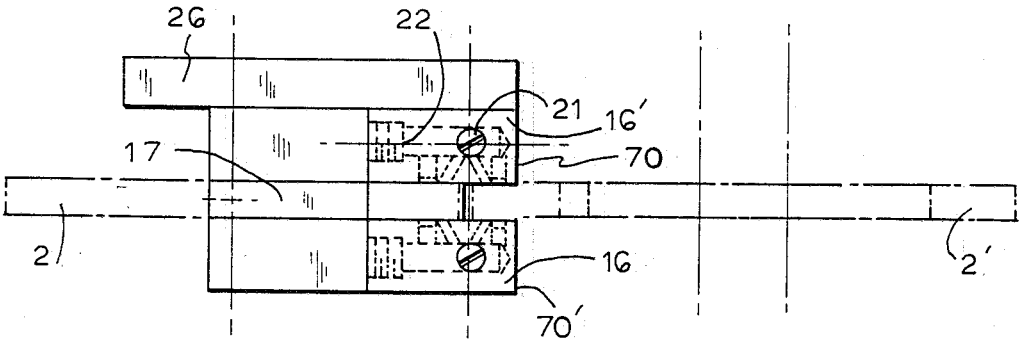
FIG. 4 is a sectional view taken along line IV—IV' of FIG. 3.

Referring now to the drawings in detail, two slender compression rolls 2 and 2' are positioned in a compression chamber 1. The axes of rolls 2 and 2' extend through a common horizontal plane. Compression roll 2 is suspended on a shaft 3 in a frame which includes a bottom plate 4, a fork-shaped vertical front plate 5 and a cover-like rear plate 5'. Compression roll 2 is driven by a motor 7 via a gear belt 6 which runs behind the rear plate 5'. Motor 7 is positioned above the frame. Compression roll 2' is suspended on a shaft 3' which is supported in a bearing bush 8. The latter is rigidly connected to two arms 9, 9' spaced from each other and to an axle 10 so that bush 8, arms 9,9' and axle 10 form a single rigid unit which is pivotable in bearings 11, 11' as a rocking member. Bearings 11, 11' are supported in plates 5,5' via the compression roll 2'. The front plate 5 and rear plate 5' are each provided in the vicinity of shaft 3' with a wide cutout 12. Compression roll 2' is driven by a motor 7' via a gear belt 6' which runs behind the rear plate 5'; compression roll 2' is driven synchronously with the compression roll 2. Motor 7 is disposed above axle 10 on the arms 9,9'. Motors 7,7' are substantially symmetrically positioned in respect to a vertical plane 13 extended through a gap between the compression rolls 2,2'. A piston-cylinder unit 14 is, on the one hand, connected to a support 15 provided on the bottom plate 4, and, on the other hand, to the extension of arm 9.

As can be readily observed from FIGS. 3, 4, 3*a* and 4*a*, the compression chamber 1 is at its four longitudinal sides limited by the front side plate 16, a cover-like rear side plate 16' and two intermediate elements 17, 17'. Both side plates 16, 16' cover the gap formed between compression rolls 2 and 2' in the operative position of the crimping device. Thbe edges 70, 70' of plates 16, 16 facing towards the compression roll 2' extend vertically. Each plate 16, 16' at the side thereof, opposite to the vertical edge, is provided with a foot or projection 18. Intermediate elements 17, 17' have sharp edges 20, 20' extended in the proximity of the gap between the compression rolls, which edges are arranged as peeling-off blades relative to the outer surfaces of the compression rolls 2, 2'. Usually the shape of the intermediate element 17 is adjusted to the shape of foot 18, and the intermediate element 17' is arranged mirror-inverted relative to the element 17.

The intermediate element 17 forms with plates 16, 16' a rigid integral unit. This unit simultaneously serves as a spacer and is adapted for maintaining a narrow gap between the side surfaces of compression rolls 2, 2' and the upper surfaces of plates 16, 16' facing towards those side surfaces.

Each plate 16, 16' has a vertically extended bore 21 which is closed from above and extends downwardly up to edges 20, 20'. A horizontal bore 22 provided in each plate 16, 16' merges into each vertical bore, respectively. Bore 22 is provided with a thread connection for a hose to be connected thereto. Bores 21 are connected by oblique passages with openings 23 and vertical grooves 24. Openings 23 face the side surfaces of compression rolls 2, 2'. Grooves 24, 24' overlap the narrow gap between the compression rolls 2, 2' and intermediate elements 17, 17'.

The unit formed of plates 16, 16' and the intermediate element 17 is connected to a holding plate 26 provided with a support member 25 by means of a rotary pin and is adjustable by screws 27, 28. The holding plate 26 is screwed to the front plate 5 of the housing frame.

The intermediate element 17' is adjustable in the same fashion (although it is not shown in the drawings) on a rocking arm 29 which is pivotable or swingable about the axis of compression roll 2' by means of a bush 30. A piston-cylinder unit 31 shown in FIG. 1 is engaged at the side of the intermediate element 17' facing away from the compression chamber 1; piston-cylinder unit 31 is connected to the arm 9 through a support 32 extended through the cutout 12.

In the operative position, the compression chamber 1 is tightly surrounded at all four longitudinal sides by the side plates 16, 16' and intermediate elements 17, 17'. The outer surfaces of both rotating compression rolls 2, 2' from therebetween a narrow gap through which a cable to be crimped is pressed into the compression chamber. Air is blown through bores 22; air partially flows through openings 23 into the narrow intermediate space, formed between the side plates 16, 16' and compression rolls 2, 2', and partially through grooves 24, 24' into the gap between intermediate elements 17, 17'. Air is blown through the system for cooling and also for preventing the penetration of individual filaments into the narrow gap.

Figure 3:
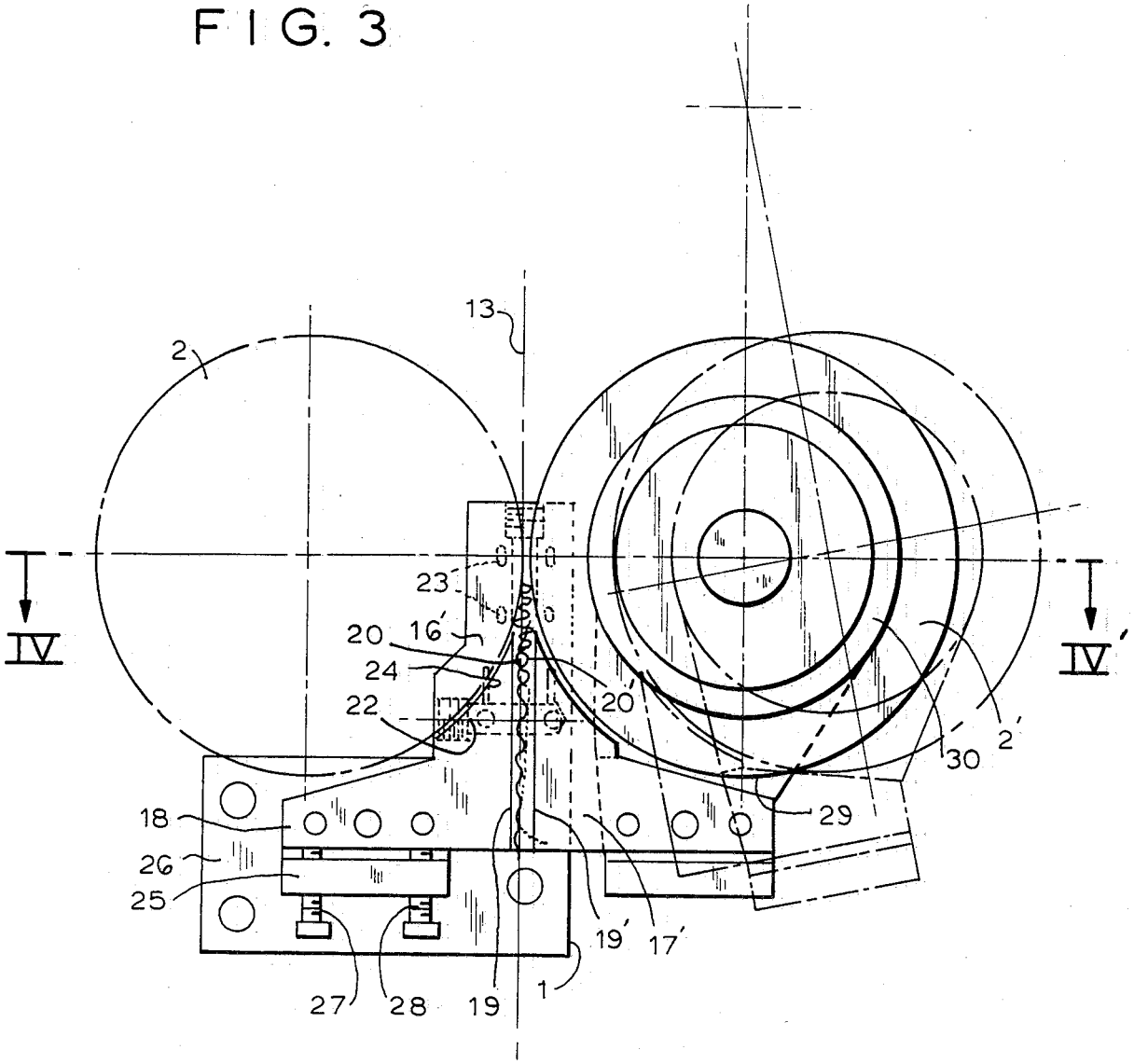
FIG. 3 is a detail of FIG. 1 on an enlarged scale.
Figure 3A:
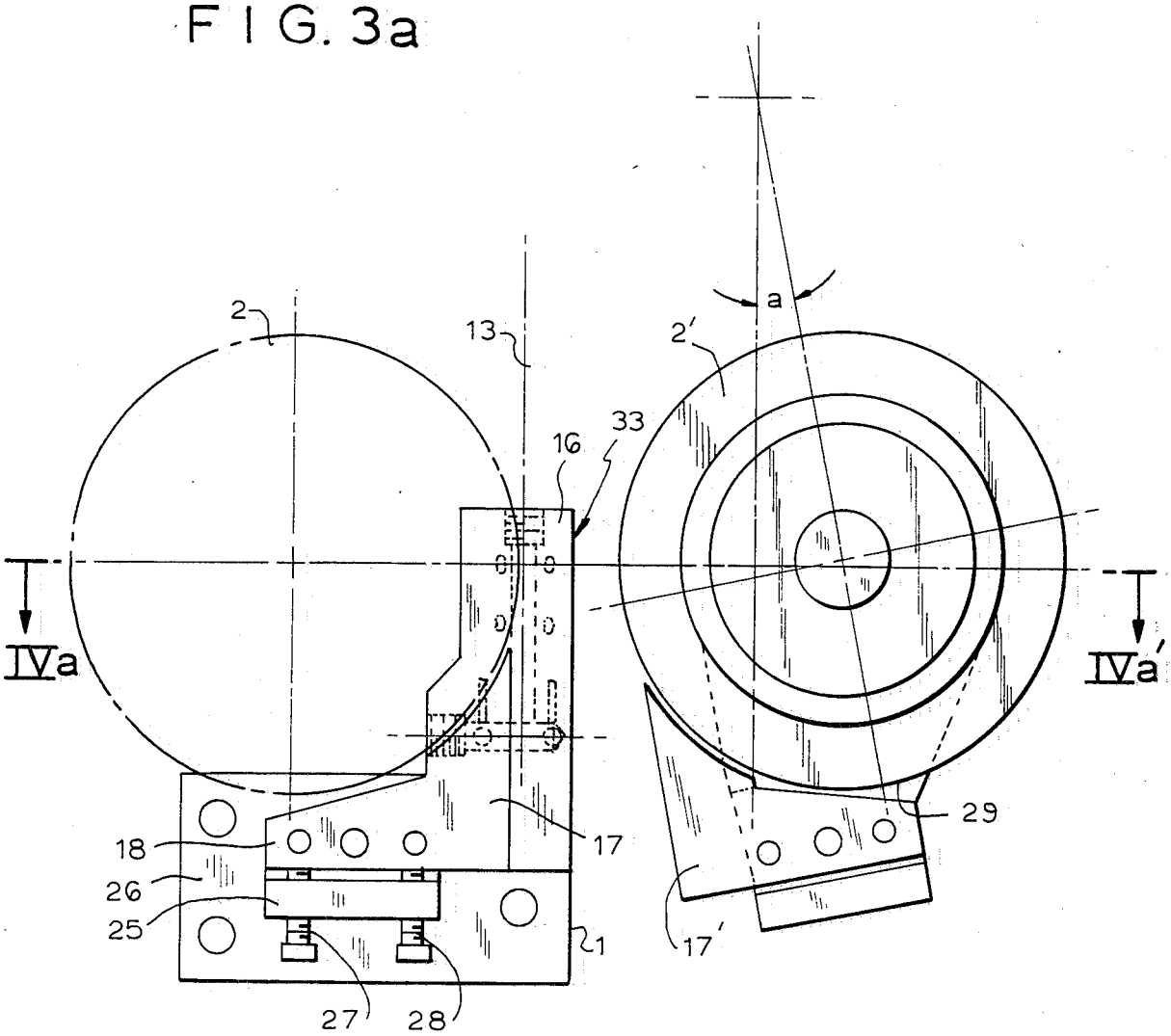
FIG. 3*a* is a detail of FIG. 3 showing the device in a ready-to-operate position.
Figure 4A:
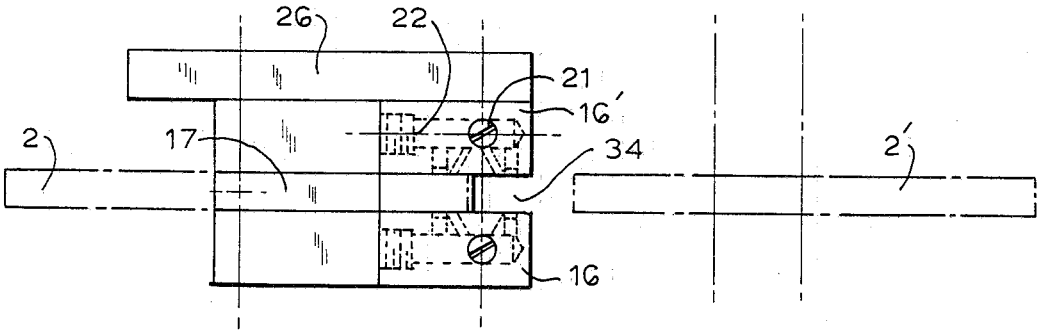
FIG. 4*a* illustrated a section taken along line IVa—IVa' of FIG. 3*a;*

FIGS. 3*a* and 4*a* illustrate the device in the ready-to-operate position. In this position, compression roll 2' is pivoted from its operative position about an angle $\alpha$. The pivoting takes place about the axle of bearings 11, 11' upon the actuation of the piston-cylinder unit 14. The intermediate element 17' is displaced together with compression roll 2' from the operative position to the pivoted-out-position so that the chamber 1 opens at its respective longitudinal side. A side passage 33 then occurs between the pivoted components and the stationary components of the device. A cable can now be inserted through this passage into the open compression chamber 1 in the direction of arrow 34 from the front side of plates 16, 16' at a full speed, for example, by means of the conventional suction injector. Finally, compression roll 2' is brought again to the operative position, the cable is lopped off below the compression chamber, the intermediate element 17', which was released in the ready-to-operate position, is again pressed by the piston-cylinder unit 31 and the crimping operation starts.

In the embodiment illustrated in FIGS. 5, 6, 5*a*, 6*a*, compression rolls 2, 2' are supported and driven in the same fashion as that described in connection with FIGS. 1–4. The compression rolls 2, 2' are each supported in a respective housing half 40, 40'. Each housing half or portion 40, 40' has the shape of the circular disc concentrical with the respective roll and with a segment cut off in the plane parallel to the plane 13 extended through the gap between compression rolls 2 and 2'. The housing portions 40, 40' are mirror-inverted relative to each other, whereby at the boundary position each portion lies closer to the compression roll 2' in a pivoted-out position thereof to the stationarily suggested compression roll 2. Each housing portion 40, 40' has a bottom plate 41, 41' and a cover plate 42, 42' bolted to the respective bottom plate. Plate 41 is flanged to the front plate 5 while plate 41' is flanged to the bearing bush 8.

Side plates 43, 43', made out of wear-resistant material and being interchangeable, are inserted in bottom plate 41 or cover plate 42 of the housing portion 40. Intermediate elements 44, 44' are positioned in concentrical recesses provided in plates 41, 41' and are clamped between the opposing faces of plates 41, 41' and 42, 42' by bolts 102, these intermediate elements each having the shape of a ring with a cut-off segment. The cut-off surfaces 45, 45' of intermediate elements 44, 44' form below the axes of the compression rolls two lateral boundaries of the compression chamber 1. Respective surfaces 46, 46' of the intermediate elements 44, 44' limit an inlet passage 47 extended through the plane 13. The inlet passage 47 is somewhat wider than the chamber 1 and the latter is slightly constricted in the downward direction in wedge-shaped manner. The angle of the wedge can be adjusted because the intermediate elements 44, 44' can be slighlty turned and thus adjusted in the corresponding concentrical recesses of plates 41, 41' which form the guides for these intermediate elements and can be then clamped by the bolts again. Screws or bolts 48, 48' which are accessible through the slots 12 in the edges of plates 41, 41' and screws 50, 50' serve for adjusting of the intermediate elements 44, 44'.

The intermediate elements 44, 44' are provided with the inner eccentrical recesses which form passages 51, 51'. Only a very small gap, which can be precisely adjusted upon the actuation of screws 50, 50', is formed between the opposing end faces 49, 49' of two intermediate elements 44 and 44' and the outer surfaces of the respective compression rolls 2, 2'. The relatively wide passage 51, 51' is formed between the inner peripheral surface of the respective intermediate element and the assigned compression roll at the side thereof facing away from the gap between the rolls. Additional enlarged recesses 52, 52' formed in the inner faces of the intermediate elements 44, 44' are positioned below the axes of compression rolls 2, 2'. Bores 53, 53' open into passages 51, 51', which are supplied with pressure air in the same manner that was described for FIGS. 3 and 4. The pressure air can escape only into the region of the compression chamber 1 and serves to efficiently cool the components of the device and to prevent filaments from penetration into the critical gap. Plates 41, 41' are provided in the regions of enlarged recesses 52, 52' with closeable openings 54, 54' similarly to openings 21 of FIGS. 3 and 4. Penetrated filament dross can be blown out through these openings. Rolls 2 and 2' are displaced in the same fashion as the compression rolls of the first embodiment.

The housing which in the operational position is fully closed opens in the manner described for FIGS. 1–4 so that in the ready-to-operate position shown in FIGS. 5*a* and 6*a*, passage 33 is free to receive a cable which can be inserted into the open inlet passage, the enlarged gap between compression rolls 2 and 2', and into the longitudinally open compression chamber 1. Compression rolls 2, 2' remain thereby practically completely enclosed or covered.

It will be understood that each of the elements described above, or two or more together, may also find a useful application in other types of crimping devices for crimping cables differing from the types described above.

While the invention has been illustrated and described as embodied in a crimping device for crimping cables, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A crimping apparatus for crimping synthetic plastic cables, comprising two rotary pressing rolls positioned relative to each other with a gap therebetween and forming a compression chamber at said gap, said rolls cooperating with each other to crimp a cable inserted into the compression chamber; two side plates and two intermediate elements enclosing said compression chamber at four sides thereof; means for displacing one of said pressing rolls and one of said intermediate elements enclosing said compression chamber from an operative position to a readiness position so as to enlarge said gap and open said compression chamber longitudinally and to provide between said rolls in said readiness position a passage for the insertion of the cable into the open compression chamber without requiring to stop the apparatus; and a housing having two housing portions each enclosing a respective pressing roll, said one pressing roll being connected to the assigned housing portion for displacement therewith, each of said intermediate elements being a ring open at a lateral side thereof by a cut-off segment and surrounding the respective pressing roll, each ring having surfaces limiting said compression chamber and each extended along a chord of the cut-off segment, each ring being guided in a concentrical recess in a respective one of said housing portions and means for securing each said ring in an adjusted position within the respective housing portion.

2. The apparatus as defined in claim 1, wherein said displacing means includes a rocking member, said one roll and said one intermediate element being supported on said rocking member which is pivotable about an axis which is parallel to an axis of said one roll.

3. The apparatus as defined in claim 2, wherein each of said rolls has an individual drive motor, the drive motor of said one roll being supported on said rocking member.

4. The apparatus as defined in claim 3, wherein said pressing rolls are supported in the apparatus in an overhung position.

* * * * *